United States Patent [19]

Carey, Jr. et al.

[11] Patent Number: 4,929,492

[45] Date of Patent: May 29, 1990

[54] STRETCHABLE INSULATING FABRIC

[75] Inventors: Patrick H. Carey, Jr.; Charles D. Cowman, Jr., both of St. Paul, Minn.

[73] Assignee: Minnesota Mining and Manufacturing Company, St. Paul, Minn.

[21] Appl. No.: 312,334

[22] Filed: Feb. 14, 1989

Related U.S. Application Data

[63] Continuation of Ser. No. 77,438, Jul. 24, 1987, abandoned.

[51] Int. Cl.[5] ..... B32B 3/00

[52] U.S. Cl. ..... 428/198; 428/284; 428/287; 428/233; 428/236; 428/903

[58] Field of Search ..... 428/198, 284, 287, 233, 428/236, 903

[56] References Cited

U.S. PATENT DOCUMENTS

| | | | |
|---|---|---|---|
| 4,118,531 | 10/1978 | Hauser | 428/224 |
| 4,438,172 | 3/1984 | Katsutoshi et al. | 428/220 |
| 4,547,420 | 10/1985 | Krueger et al. | 428/229 |
| 4,551,378 | 11/1985 | Carey, Jr. | 428/198 |
| 4,657,802 | 4/1987 | Morman | 428/152 |

OTHER PUBLICATIONS

Wente, Van A., "Superfine Thermoplastic Fibers," (1956), Industrial Engineering Chemistry, vol. 48, p. 1342 et seq., Report No. 4364 of Naval Research Laboratories, 5/25/54, Manufacture of Superfine Organic Fibers, Wente et al.

*Primary Examiner*—Marion C. McCamish
*Attorney, Agent, or Firm*—Donald M. Sell; Walter N. Kirn; Roger R. Tamte

[57] ABSTRACT

An elastically stretchable fabric having enhanced thermal insulation properties comprising at least one elastically stretchable carrier web having substantially uniform stretch properties and a thin coherent coated layer of melt-blown microfibers carried on at least one surface of the carrier web, said melt-blown microfibers being selected from the group consisting of polypropylene, polyethylene, polyurethane, polyethylene terephthalate or mixtures thereof.

21 Claims, No Drawings

STRETCHABLE INSULATING FABRIC

This is a continuation of application Ser. No. 077,438 filed July 24, 1987 now abandoned.

FIELD OF THE INVENTION

The present invention relates to stretchable fabrics having enhanced thermal insulation properties, and which are particularly useful in thin, close-fitting outdoor apparel such as skiwear, gloves and work clothing.

BACKGROUND ART

Nonwoven thermally insulating elastically stretchable fabrics are taught in U.S. Pat. No. 4,551,378. Although these fabrics offer good insulating properties and comfort in wearing, the present invention makes possible even better insulating properties. Fabric as taught in U.S. Pat. No. 4,551,378 can be a component of fabric of the invention.

A different stretchable nonwoven thermal insulating fabric, which in one embodiment comprises a nonwoven web formed from thin fibrous layers laminated together, with the fibers comprising a polyester type copolymer containing butylene terephthalate, is taught in U.S. Pat. No. 4,438,172.

Another nonwoven thermal insulating fabric having stretch properties is commercially available under the trademark "Viwarm" from a Japanese manufacturer. The material is a spray-bonded, lightly needle-tacked nonwoven web of a blend of one- and three-denier single-component polyester fibers, the three-denier fiber having sufficient crimp to provide stretch properties. The product has a high "power stretch" (i.e., it requires a large force to stretch the fabric), and it does not have the combination of thermal insulating properties and low density offered in the present invention.

A different item of background prior art, relevant because it teaches blends of fibers useful in some embodiments of the present invention, is U.S. Pat. No. 4,118,531. This patent teaches blends of melt-blown microfibers and crimped staple textile fibers, which form lofty, high-insulating-value fabric or sheet material.

SUMMARY OF THE INVENTION

The present invention provides a new elastically stretchable fabric having a surprisingly high insulating value in view of its relative thinness, and which can be repeatedly stretched without losing its thermal insulative properties or its dimensional integrity. Briefly summarized, the new stretchable fabric, sometimes referred to herein as a "stretch fabric," comprises at least one elastically stretchable fibrous carrier web having substantially uniform stretch properties and carrying a thin coherent layer of microfibers coated on at least one surface of the carrier web. A coated layer of melt-blown microfibers is preferred and when deposited on the carrier web as a thin layer, preferably having a weight less than about 30 g/m$^2$, greatly enhances the thermal insulating character of the fabric and functions as a substantially integral part of the fabric, e.g., stretches and retracts with the carrier web as the latter stretches and retracts and remains in adherent contact with the carrier web. It is preferred that the thermal insulating property of the fabric is at least 20% greater than the thermal insulating property of the carrier web, and more preferably at least 50% greater.

DETAILED DESCRIPTION

Carrier webs used in the present invention may comprise any elastically stretchable fibrous material, but preferably comprise a nonwoven web of bicomponent fibers bonded together by fusion of fibers at points of contact and thermally crimped in situ as is described in U.S. Pat. No. 4,551,378, which is incorporated herein by reference. The carrier webs should have substantially uniform low power stretch properties such as provided by the webs described in that patent. The carrier web (and finished fabric of the invention) preferably substantially recovers its original dimensions and insulation properties after repeated (i.e., 10 or more) extensions of 40% above its original dimension.

It is usually desirable that the bulk density of the carrier web be kept relatively low so as to provide good thermal insulating properties while keeping the web weight low. Weights of about 30 to 150 g/m$^2$ and densities ranging from about 0.005 to 0.020 g/cm$^3$ are preferable in the carrier web for most apparel applications. Also, carrier webs included in webs of the present invention are preferably permeable so as to facilitate the transfer of moisture through the total construction. Without adequate permeability, moisture will accumulate in the garment and adversely impact its ability to keep the wearer warm. Carrier webs should have a permeability (such as a Frazier permeability) of at least about 0.25 m$^3$/sec/m$^2$ (50 ft$^3$/min/ft$^2$) with a flow resistance of 124 Pa (½ inch water gauge pressure).

The microfiber-based coated layers of the present invention are typically comprised of fibers having an average diameter of less than about 10 micrometers. They can be prepared by a variety of techniques including solution-blowing or melt-blowing processes, but preferably are prepared by a melt-blowing process. A number of polymeric materials may be used for the preparation of the microfibers, including but not limited to polyethylene, polypropylene, polyethylene terephthalate (PET), and polyurethanes. Combinations of such polymers can be used as bicomponent fibers, e.g., as polyethylene/polypropylene or polypropylene/polyethylene terephthalate bicomponent fibers taught in microfiber form in U.S. Pat. No. 4,547,420, or also in some cases as blends. Coating weights are chosen to provide sufficient thermal insulation for the contemplated use of the finished fabric, but generally are at least about 5 g/m$^2$ and preferably at least 10 g/m$^2$. The most preferred range, especially for melt-blown microfibers, is about 10–20.

Crimped staple textile fibers may be included in the microfiber-based coated layers in the fabrics of the present invention to achieve increased loft, but microfibers generally comprise at least 50 or 60 weight-percent of the coating.

The microfibers used in the invention are typically prepared by means of a melt-blowing process, for example, as taught by Wente, Van A., "Superfine Thermoplastic Fibers," in Industrial Engineering Chemistry, Vol. 48, pages 1342 et seq, (1956), or in Report No. 4364 of the Naval Research Laboratories, published May 25, 1954, entitled "Manufacture of Superfine Organic Fibers" by Wente, Van A.; Boone, C. D. and Fluharty, E. L. The microfibers are typically collected directly onto the carrier web, as by interposing the webs in an air stream of the fibers. The carrier web can be held in either a relaxed or an extended configuration. Microfibers or mixtures of microfibers and staple textile fibers are able to penetrate into the web to a greater degree when the carrier web is in a stretched configuration and become more mechanically entwined, but good entwining is also achieved in the relaxed state. Melt-blown microfibers have good conformance and become well-entwined with the carrier web so as to remain adhered to the web with just mechanical entwining.

The present invention is further described by the following non-limiting examples.

EXAMPLES 1-6

A series of fabrics of the invention were prepared using as the carrier web a 34-g/m$^2$-basis weight elastically stretchable nonwoven web as described in U.S. Pat. No. 4,551,378 made from staple highly eccentric sheath-core type bicomponent fibers having a polypropylene core and polyethylene sheath (Chisso ES fibers available from Chisso Corporation, Osaka, Japan). Polypropylene melt-blown microfiber coated layers were applied to the carrier web by feeding the carrier web under slight tension around a portion of the rotating collector drum of a melt-blowing apparatus similar to that described in U.S Pat. No. 4,118,531, which is incorporated herein by reference. A range of coating weights and collector/die distances were utilized in preparing a variety of samples, as described in Table I.

TABLE I

| Example | Coating Weight (g/m$^2$) | Collector Distance (cm) | Finished Web Thickness (cm) | Finished Web Density (g/m$^3$) |
|---|---|---|---|---|
| 1 | Control | — | .22 | .015 |
| 2 | 8 | 6 | .261 | .013 |
| 3 | 8 | 14 | .244 | .014 |
| 4 | 16 | 10 | .28 | .012 |
| 5 | 24 | 6 | .332 | .010 |
| 6 | 24 | 14 | .285 | .012 |

| Example | Insulating Value (Clo) | Insulating Value (Clo/cm) | % Thickness Increase From Coating | % Clo Increase From Coating |
|---|---|---|---|---|
| 1 | .34 | 1.545 | Control | — |
| 2 | .451 | 1.73 | 18.6 | 32.6 |
| 3 | .477 | 1.96 | 10.9 | 40.3 |
| 4 | .53 | 1.89 | 28.0 | 56.0 |
| 5 | .604 | 1.82 | 50.9 | 77.6 |
| 6 | .582 | 2.04 | 29.5 | 71.2 |

The power stretch (force required to stretch) of all the above samples fell within the range of 400 to 800 g for a 40% elongation of the sample.

EXAMPLE 7

A fabric of the invention similar to that of Example 4 was prepared, except that 6-denier polyethylene terephthalate staple fibers, 3.8 cm in length, were incorporated (using apparatus as taught in U.S. Pat. No. 4,118,531) into the coated layer in an amount of 8 g/m$^2$ in addition to the 16 g/m$^2$ of microfibers. The finished material had a thickness of 0.44 cm and a clo value of 0.826 which corresponded to a thickness increase of 100%, a clo increase of 142.9% and a clo/cm of 1.88.

EXAMPLES 8-11

A series of fabrics of the invention were prepared using a carrier web as used in Example 1 except that the latter had a basis weight of about 40 g/m$^2$. Nylon melt-blown microfiber coatings were applied to the carrier web using conditions, and obtaining results, as described in Table II.

TABLE II

| Example | Coating Weight (g/m$^2$) | Collector Distance (cm) | Finished Web Thickness (cm) | Finished Web Density (g/m$^3$) |
|---|---|---|---|---|
| 8 | 15 | 8 | 0.21 | 0.0267 |
| 9 | 20 | 16 | 0.22 | 0.0282 |
| 10 | 29 | 24 | 0.23 | 0.0291 |
| 11 | Control | — | 0.22 | 0.0191 |

| Example | Insulating Value (Clo) | Insulating Value (Clo/cm) | Permeability (ft$^3$/min/ft$^2$) | Permeability (m$^3$/s/m$^2$) | % Thickness Increase From Coating | % Clo Increase From Coating |
|---|---|---|---|---|---|---|
| 8 | 0.354 | 1.68 | 190 | .965 | (4.5)* | 15.3 |
| 9 | 0.369 | 1.67 | 145 | .737 | 0.0 | 20.2 |
| 10 | 0.428 | 1.86 | 80 | .40 | 4.5 | 39.4 |
| 11 | 0.307 | 1.39 | — | — | Control | — |

*thickness decreased

EXAMPLES 12-15

A series of fabrics of the invention were prepared using a carrier web as described in Example 1 except that it had a basis weight of about 43 g/m$^2$. Polyethylene terephthalate (PET) melt-blown microfibers were coated onto the carrier web under conditions, and with results, as described in Table III.

TABLE III

| Example | Coating Weight (g/m$^2$) | Collector Distance (cm) | Finished Web Thickness (cm) | Finished Web Density (g/m$^3$) |
|---|---|---|---|---|
| 12 | 14 | 8 | 0.25 | 0.0228 |
| 13 | 17 | 16 | 0.25 | 0.0244 |
| 14 | 25 | 24 | 0.28 | 0.0250 |
| 15 | Control | — | 0.22 | 0.0191 |

| Example | Insulating Value (Clo) | Insulating Value (Clo/cm) | Permeability (ft$^3$/min/ft$^2$) | Permeability (m$^3$/s/m$^2$) | % Thickness Increase From Coating | % Clo Increase From Coating |
|---|---|---|---|---|---|---|
| 12 | 0.430 | 1.72 | 218 | 1.11 | 13.6 | 40.1 |
| 13 | 0.408 | 1.64 | 226 | 1.15 | 13.6 | 32.9 |
| 14 | 0.474 | 1.53 | 170 | .86 | 27.3 | 54.4 |
| 15 | 0.307 | 1.39 | — | — | Control | — |

EXAMPLES 16-18

A series of fabrics of the invention were prepared using a carrier web as described in Examples 1-6 except that it had a basis weight of about 84.4 g/m$^2$.

TABLE IV

| Example | Coating Weight (g/m$^2$) | Collector Distance (cm) | Finished Web Thickness (cm) | Finished Web Density (g/m$^3$) |
|---|---|---|---|---|
| 16 | 14 | 16 | 0.457 | 0.0215 |
| 17 | 8.2 | 16 | 0.473 | 0.0196 |
| 18 | Control | — | 0.420 | 0.0201 |

| Example | Insulating Value (Clo) | Insulating Value (Clo/cm) | Permeability (ft$^3$/min/ft$^2$) | Permeability (m$^3$/s/m$^2$) | % Thickness Increase From Coating | % Clo Increase From Coating |
|---|---|---|---|---|---|---|
| 16 | 0.780 | 1.71 | 218 | 1.11 | 8.8 | 21.1 |
| 17 | 0.774 | 1.64 | 229 | 1.63 | 12.6 | 15.5 |

TABLE IV-continued

| | | | | | | |
|---|---|---|---|---|---|---|
| 18 | 0.644 | 1.53 | 52 | .26 | Control | — |

We claim:

1. An elastically stretchable fabric having enhanced thermal insulation properties comprising at least one elastically stretchable fibrous carrier web having substantially uniform stretch properties and that may be repeatedly stretched and yet return to its original dimensions; and, as a separate layer different in composition from the carrier web, a thin coherent layer of blown microfibers averaging less than 10 micrometers in diameter coated on at least one surface of the carrier web, the layer of microfibers having an average weight of less than about 30 g/m$^2$ and being deposited on the carrier web and mechanically intertwined with the fibers of the carrier web.

2. The stretchable fabric of claim 1 wherein the microfibers are included in an amount sufficient for the thermal insulating property of said fabric to be at least 50% greater than the thermal insulating property of said carrier web.

3. The stretchable fabric of claim 1 wherein said coated layer of microfibers has an average weight of between about 10 and about 30 g/m$^2$.

4. The stretchable fabric of claim 1 wherein the microfibers are included in an amount sufficient for the thermal insulating property of said fabric to be at least 20% greater than the thermal insulating property of said carrier web.

5. The stretchable fabric of claim 1 in which crimped staple fibers are included in the coated layer of microfibers in an amount up to 35% by weight of the layer.

6. The stretchable fabric of claim 1 wherein said carrier web is nonwoven and comprises crimped fibers.

7. The stretchable fabric of claim 10 wherein fibers within the carrier web are bonded together at spaced locations.

8. The stretchable fabric of claim 1 wherein said carrier web comprises a nonwoven web of bicomponent fibers bonded together by fusion of fibers at points of contact and thermally crimped in situ in the web.

9. The stretchable fabric of claim 1 wherein said carrier web has a weight of between about 30 and about 150 g/m$^2$.

10. The stretchable fabric of claim 1 wherein said carrier fabric has a bulk density of between about 0.005 and about 0.020 g/cm$^3$.

11. The stretchable fabric of claim 1 wherein a layer of microfibers is carried on both surfaces of the carrier web.

12. The stretchable fabric of claim 1 wherein a second elastically stretchable fibrous web is disposed over the coated layer of microfibers.

13. The stretchable fabric of claim 1 wherein said fabric will substantially recover its original dimensions and insulation properties after repeated extension of 40% above the original fabric dimension.

14. The stretchable fabric of claim 1 wherein the carrier web has a permeability of at least about 0.25 m$^3$/s/m$^2$ with a flow resistance of 124 Pa.

15. The stretchable fabric of claim 1 wherein the coated layer of microfibers weight between about 10 and 20 g/m$^2$.

16. The stretchable fabric of claim 1 in which crimped staple fibers are included in the coated layer of microfibers, the microfibers comprising at least 50 weight-percent of the layer.

17. A stretchable fabric having enhanced thermal insulation properties comprising at least one elastically stretchable nonwoven crimped-fabric-based carrier web and, as a separate layer different in composition from the carrier web, a thin coherent layer of melt-blown microfibers less than about 30 g/m$^2$ in weight deposited and mechanically intertwined with fibers on at least one surface of the carrier web.

18. The stretchable fabric of claim 16 wherein the carrier web has a permeability of at least about 0.25 m$^3$/s/m$^2$ with a flow resistance of 124 Pa.

19. The stretchable fabric of claim 16 wherein the carrier web has a bulk density of between about 0.005 and 0.020 g/cm$^3$ and comprises a nonwoven web of bicomponent fibers bonded together by fusion of fibers at points of contact and thermally crimped in situ in the web.

20. The stretchable fabric of claim 16 wherein the coated layer of microfibers weighs between about 10 and 20 g/m$^2$.

21. An elastically stretchable fabric having enhanced thermal insulation properties comprising at least one elastically stretchable carrier web having substantially uniform stretch properties and a thin coherent coated layer of melt-blown microfibers carried on at least one surface of the carrier web, said melt-blown microfibers being selected from the group consisting of polypropylene, polyethylene, polyurethane, polyethylene terephthalate or mixtures thereof.

* * * * *